US006819883B2

(12) United States Patent
Nakase et al.

(10) Patent No.: US 6,819,883 B2
(45) Date of Patent: Nov. 16, 2004

(54) TONER SUPPLY ARRANGEMENT FOR A DEVELOPING DEVICE

(75) Inventors: Takahiro Nakase, Ibaraki (JP); Ryuji Kawano, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/327,179

(22) Filed: Dec. 24, 2002

(65) Prior Publication Data

US 2003/0152394 A1 Aug. 14, 2003

(30) Foreign Application Priority Data

Dec. 27, 2001 (JP) ..... 2001-398374

(51) Int. Cl.[7] ..... G03G 15/08
(52) U.S. Cl. ..... 399/27; 399/29; 399/258
(58) Field of Search ..... 399/27, 29, 30, 399/258, 260, 279

(56) References Cited

U.S. PATENT DOCUMENTS 4,358,196 A * 11/1982 Mugrauer ..... 399/258
4,848,267 A * 7/1989 Slayton et al. ..... 399/279
4,922,294 A * 5/1990 Nakagami et al. ..... 399/27
5,329,340 A * 7/1994 Fukuchi et al. ..... 399/260
5,592,270 A * 1/1997 Takai et al. ..... 399/260
5,652,947 A * 7/1997 Izumizaki ..... 399/258

FOREIGN PATENT DOCUMENTS

JP 05-204244 * 8/1993 ..... G03G/15/08
JP 09-211952 * 8/1997 ..... G03G/15/08

* cited by examiner

*Primary Examiner*—Fred Braun
(74) *Attorney, Agent, or Firm*—Fitzpatrick, Cella, Harper & Scinto

(57) ABSTRACT

A developing device has a structure in which a toner is supplied from a toner supplying container to a first toner container by a toner supplying device and also the toner is conveyed from the first toner container to a second toner container by a toner conveying member disposed so as to lie in the space between the first and second toner containers. Thus, the developing device has a reduced size and also stably supplies the toner to two developing rollers corresponding to the first and second toner containers.

8 Claims, 6 Drawing Sheets

TONER SUPPLY ARRANGEMENT FOR A DEVELOPING DEVICE

BACKGROUND OF THE INVENTION

1. Field of the Invention

The present invention relates to a developing device, for example, used in a copying machine, a printer, or a facsimile machine of an electro-photographic type, an electronic recording type, or the like, for developing an electrostatic image formed on an image bearing member by supplying developers (toners) from first and second developer bearing members.

2. Description of the Related Art

In recent years, image forming apparatuses such as a copying machine and a printer have been required to output a printed image at increasingly higher speeds.

However, in a known developing device of the image forming apparatus, when a toner supplied from a toner container is held on the surface of one developing roller and an electrostatic latent image is developed (i.e., is visualized) by jumping (i.e., accreting) the toner on the latent image formed on a photoreceptor in an electrostatic manner, the toner held on the surface of the developing roller which is rotating at a high speed because of the speedup requirement quickly deteriorates.

In addition, the speedup causes the developer borne on the developing roller to jump on the photoreceptor and develop the latent image in a short period of time, thereby leading to a loss in image quality.

To solve the above-described problems, a developing device having a plurality of developing rollers for developing a latent image at each roller has been proposed. With this developing device, the deterioration of the toner and the loss in image quality of the high-speed image forming apparatus can be suppressed.

For example, as shown in FIG. 4, a developing device 101 has a structure in which a toner container 102 for containing a toner t has an opening opposing a photosensitive drum 100 where two developing rollers 103*a* and 103*b* are disposed. The surfaces of the developing rollers 103*a* and 103*b* are coated with thin films of the toner t by two regulating blades 104*a* and 104*b*.

In this developing device 101, the toner t is supplied from a toner supplying container 106 to the toner container 102 via a toner conveying device 107 on the basis of the data of a toner amount detected by a toner-amount detecting sensor 105.

Also, as shown in FIG. 5, the developing device 101 has another structure in which toner containers 102*a* and 102*b* have developing rollers 103*a* and 103*b*, respectively. In this developing device 101, the toner t is supplied from the toner supplying container 106 to the toner containers 102*a* and 102*b* via corresponding toner conveying devices 107*a* and 107*b* on the basis of the data of toner amounts detected by corresponding toner-amount detecting sensors 105*a* and 105*b*.

Although the known developing device 101 shown in FIG. 4 having only one toner container 102 and one toner conveying device 107 has a reduced size advantage, when the amount of the toner t in the toner container 102 varies in the range H shown in the figure, a supply amount of the toner t supplied to the developing roller 103*a* is different from that supplied to the developing roller 103*b*.

That is, as shown in FIG. 6, since a toner coating amount coated on the surface of the developing roller 103*a* disposed upstream with respect to the rotating direction of the photosensitive drum 100 varies depending on the amount of the toner t in the toner container 102, the toner coating amount decreases as a supply amount of the toner t supplied to the developing roller 103*a* decreases, resulting in a loss in image quality of an output image.

On the other hand, in the developing device 101 shown in FIG. 5, since supply amounts of the toner t supplied to the toner containers 102*a* and 102*b* are adjusted by the corresponding toner conveying devices 107*a* and 107*b*, stable amounts of the toner t are coated on the surfaces of the developing rollers 103*a* and 103*b*. However, since the toner conveying devices 107*a* and 107*b* are disposed for supplying the toner t to the corresponding toner containers 102*a* and 102*b*, a space for housing two toner conveying devices is required, thereby resulting in an increased size of the developing device 101.

In particular, since the image forming apparatus not only performing at a high speed but also having a reduced size has been required in recent years, a compact developing device having a plurality of developing rollers also has been desired.

SUMMARY OF THE INVENTION

It is an object of the present invention to provide a developing device which has a reduced size and stably supplies a developer or a toner.

A developing device comprises a first developer container for containing a developer; a first developer bearing member for bearing and conveying the developer in the first developer container; a second developer container for containing a developer; and a second developer bearing member for bearing and conveying the developer in the second developer container. An electrostatic image formed on an image bearing member is developed by supplying the developers from the first and second developer bearing members to the electrostatic image. The developing device further comprises developer supplying means for supplying the developer in a developer supplying container to the first developer container; and developer conveying means for conveying the developer in the first developer container to the second developer container in order to supply the developer to the second developer container.

Further objects, features and advantages of the present invention will become apparent from the following description of the preferred embodiments with reference to the attached drawings.

DESCRIPTION OF THE PREFERRED EMBODIMENTS

Preferred embodiments of the present invention will be described with reference to the accompanying drawings.

First Embodiment

Figure 1:
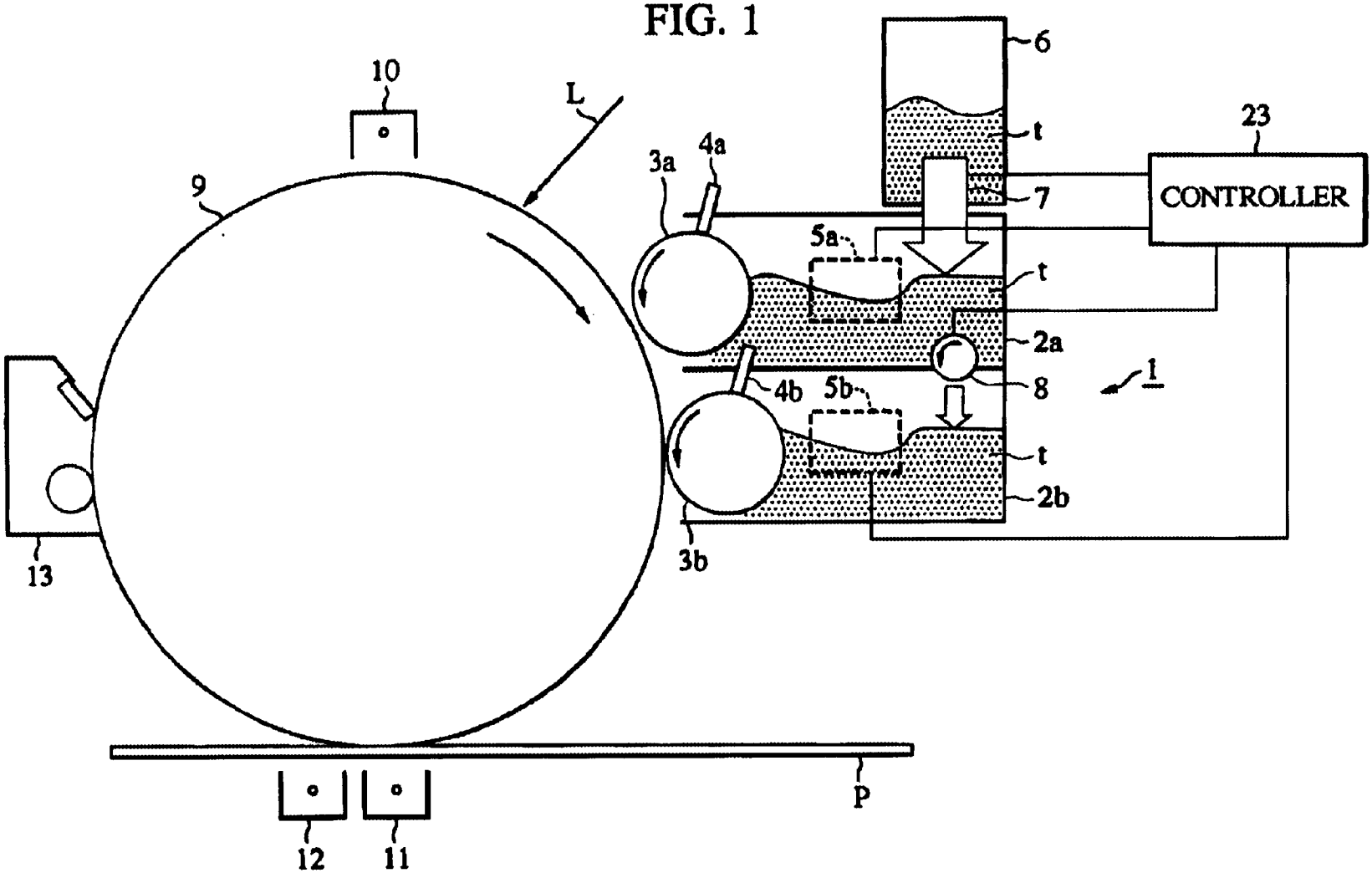
FIG. 1 is a schematic view illustrating the main part of an image forming apparatus having a developing device according to a first embodiment of the present invention.

FIG. 1 is a schematic view illustrating the main part of an image forming apparatus having a developing device according to a first embodiment of the present invention.

The image forming apparatus has a developing device 1, a primary charger 10, a transfer charger 11, a detach charger 12, and a cleaner 13 around a drum-shaped electrophotographic photoreceptor (hereinafter, referred to as a photosensitive drum) 9 serving as a developer bearing member. When an image is being formed, an exposure device (not shown) sheds image exposing light L on the photosensitive drum 9 which is charged by the primary charger 10 and rotates in the direction by the arrow indicated in the figure (i.e., a clockwise direction) and an electrostatic latent image is formed in accordance with input image data. In this stage, two developing rollers 3*a* and 3*b* of the developing device 1, which will be described in detail later, are applied with a developing bias having the same polarity as the charged developing device 1, and a toner (developer) t is charged so as to have the same polarity as the charged developing device 1. Thus, the charged toner t is accreted to the electrostatic latent image by the two developing rollers 3*a* and 3*b* so that the latent image is visualized as a toner image (a developer image). The toner t may be a magnetic single-component developer, for example.

When the toner image formed on the photosensitive drum 9 exactly reaches a transfer nip between the photosensitive drum 9 and the transfer charger 11, a transfer material P such as a sheet of paper is fed to the transfer nip, and the toner image formed on the photosensitive drum 9 is transferred to the transfer material P by the transfer charger 11 applied with a transfer bias having the opposite polarity as the toner t by using an electrostatic force produced between the photosensitive drum 9 and the transfer charger 11.

The transfer material P having the transferred toner image thereon is detached from the photosensitive drum 9 by the detach charger 12 applied with a detach bias and is transferred to a fixing device (not shown). Then, the toner image is fixed to the transfer material P at a fixing nip between the fixing device and a pressure roller (not shown) by heating and pressuring and is output to the outside. The toner remaining on the photosensitive drum 9 after the above-described transfer is removed and collected by the cleaner 13.

Next, the structure of the developing device 1 according to the first embodiment will be described.

The developing device 1 according to the first embodiment has first and second toner containers 2*a* and 2*b* for containing the toner t; a toner supplying container 6; a toner supplying device 7 serving as toner supplying means for supplying and conveying the toner t in the toner supplying container 6 to the first toner container 2*a*; and the developing rollers 3*a* and 3*b* disposed in the openings of the first and second toner containers 2*a* and 2*b*, respectively, along the rotating direction of the photosensitive drum 9, so as to oppose the photosensitive drum 9 in the developing region of the developing device 1 and to serve as developer bearing members which are rotatable in the direction of the arrow indicated in the figure (i.e., a counterclockwise direction). As described above, the developing device 1 according to the first embodiment has the two first and second toner containers 2*a* and 2*b* which are formed independently from each other.

The first and second toner containers 2*a* and 2*b* respectively have regulating blades 4*a* and 4*b*, for coating the toner t on the developing rollers 3*a* and 3*b*, and toner-amount detecting sensors 5*a* and 5*b* for detecting toner amounts therein. Also, the first and second toner containers 2*a* and 2*b* have a communication opening therebetween and a toner conveying member 8, placed in the communication opening, for conveying and supplying the toner t in the first toner container 2*a* supplied from the toner supplying container 6 to the second toner container 2*b*. The toner conveying member 8 may be a magnet roller, for example, which will be described in the second embodiment.

The first toner container 2*a* is integrally disposed with and above the second toner container 2*b* and the communication opening is formed in a separation portion which separates these two toner containers 2*a* and 2*b* above and below, respectively. The toner supplying device 7 and the toner conveying member 8 may be formed by known conveying members.

Conveyance and supply of the toner t from the toner supplying container 6 to the first toner container 2*a* by the toner supplying device 7 and those from the first toner container 2*a* to the second toner container 2*b* by the toner conveying member 8 are controlled by a controller 23 on the basis of detection data received from the toner amount detecting sensors 5*a* and 5*b*, respectively.

The conveyances of the toner t to the first and second toner containers 2*a* and 2*b* in the developing device 1 according to the first embodiment will be described below.

When the toner-amount detecting sensor 5*a* detects that the toner t in the first toner container 2*a* decreases as the developing device 1 operates, the controller 23 causes the toner supplying device 7 to operate on the basis of the received detection data so as to convey the toner t from the toner supplying container 6 to the first toner container 2*a*. The toner t in the first toner container 2*a* is supplied to the developing roller 3*a* by an agitating and conveying member (not shown) and used for developing an electrostatic image formed on the photosensitive drum 9.

Also, when the toner-amount detecting sensor 5*b* detects that the toner t in the second toner container 2*b* decreases as the developing device 1 operates, the controller 23 causes the toner conveying member 8 to operate on the basis of the received detection data so as to convey the toner t from the first toner container 2*a* to the second toner container 2*b*. The toner t in the second toner container 2*b* is supplied to the developing roller 3*b* by another agitating and conveying member (not shown) and used for developing an electrostatic image formed on the photosensitive drum 9.

In the first embodiment, in the case in which the toner t is supplied from the toner supplying container 6 to the first toner container 2*a* by the toner supplying device 7 and is also conveyed from the first toner container 2*a* to the second toner container 2*b*, when a conveyance (supply) amount of the toner t per unit of time from the toner supplying container 6 to the first toner container 2*a* by the toner supplying device 7 is defined as A, the maximum necessary amount of the toner t per unit of time conveyed onto the developing roller 3*a* for developing is defined as B, and the maximum necessary amount of the toner t per unit of time conveyed onto the developing roller 3*b* for developing is defined as C, these three amounts are controlled by the controller 23 so as to satisfy the following formula:

$$A \geq B+C \quad (1).$$

By controlling these amounts as described above, even when the toner-amount detecting sensors 5*a* and 5*b* detect shortages of the toner t in the corresponding first and second toner containers 2*a* and 2*b* substantially at the same time, the toner t is sufficiently supplied to both developing rollers 3*a* and 3*b*.

As described above, according to the first embodiment, by using the single common toner supplying container 6, the toner t is effectively conveyed to both first and second toner containers 2*a* and 2*b* and is thus stably and sufficiently supplied to both developing rollers 3*a* and 3*b*. In addition, the toner conveying member 8 placed between the first and second toner containers 2*a* and 2*b* conveys the toner t to the second toner container 2*b*, thereby leading to a reduced size of the developing device 1 and also to a stable supply of the toner t to both developing rollers 3*a* and 3*b*.

Second Embodiment

Figure 2:
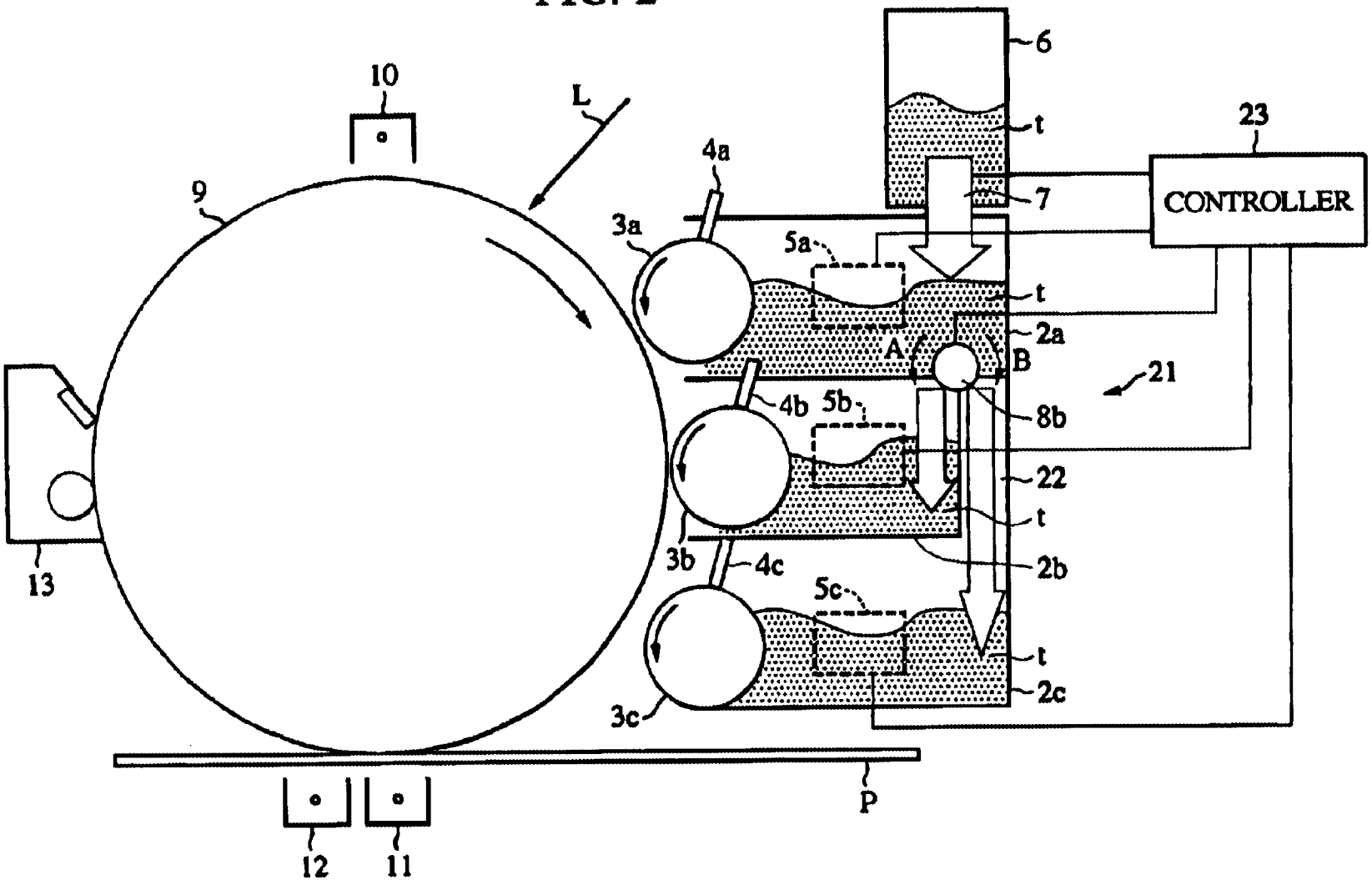
FIG. 2 is a schematic view illustrating the main part of the image forming apparatus having a developing device according to a second embodiment of the present invention.

FIG. 2 is a schematic view illustrating the main part of the image forming apparatus having a developing device according to a second embodiment of the present invention. Like parts are identified by the same reference numerals and symbols in the first embodiment and a repeated description thereof is omitted. In the second embodiment, only the developing device will be described since the image forming apparatus has the same structure as that in the first embodiment except for the developing device.

As shown in FIG. 2, a developing device 21 according to the second embodiment has the first and second toner containers 2*a* and 2*b* and a third toner container 2*c* for containing the toner t; the toner supplying device 7; the toner supplying container 6 for conveying (supplying) the toner t to the first toner container 2*a* via the toner supplying device 7; and the developing rollers 3*a* and 3*b* and a developing roller 3*c* disposed in the openings of the first to third toner containers 2*a* to 2*c*, respectively, so as to serve as developer bearing members which oppose the photosensitive drum 9 in the developing region of the developing device 21 and which are rotatable in the direction of the arrow indicated in the figure (i.e., a counterclockwise direction). As described above, the developing device 21 according to the second embodiment has the three first to third toner containers 2*a* to 2*c* which are formed independently from each other.

The first to third toner containers 2*a* to 2*c* respectively have the regulating blades 4*a* and 4*b* and a regulating blade 4*c* for coating the toner t on the developing rollers 3*a* to 3*c*, in addition to having the toner-amount detecting sensors 5*a* and 5*b* and a toner-amount detecting sensors 5*c* for detecting toner amounts therein.

The first to third toner containers 2*a* to 2*c* are integrally disposed in the vertical direction. Also, the developing device 21 has a toner conveying member 8*b* and a conveying passage 22, for conveying (supplying) the toner t in the first toner container 2*a* to the third toner container 2*c* via the toner conveying member 8*b*, in the space between the wall of the second toner container 2*b* lying opposite to the developing roller 3*b* and the upper surface of the third toner container 2*c*.

The toner conveying member 8*b* is disposed under the first toner container 2*a* so as to lie in the space formed by upper surface of the second toner container 2*b* and the conveying passage 22 above the third toner container 2*c*. The toner conveying member 8*b* in the second embodiment is the foregoing magnet roller which is disposed in the longitudinal direction of developing roller 3*a* and whose rotating direction is controllable. When the toner conveying member (magnet roller) 8*b* is controlled to rotate in the direction of the arrow A indicated in the figure (a counterclockwise direction), the toner t is conveyed to the second toner container 2*b*, and when the toner conveying member (magnet roller) 8*b* is controlled to rotate in the direction of the arrow B indicated in the figure (a clockwise direction), the toner t is conveyed to the third toner container 2*c* via the conveying passage 22.

Figure 3A:
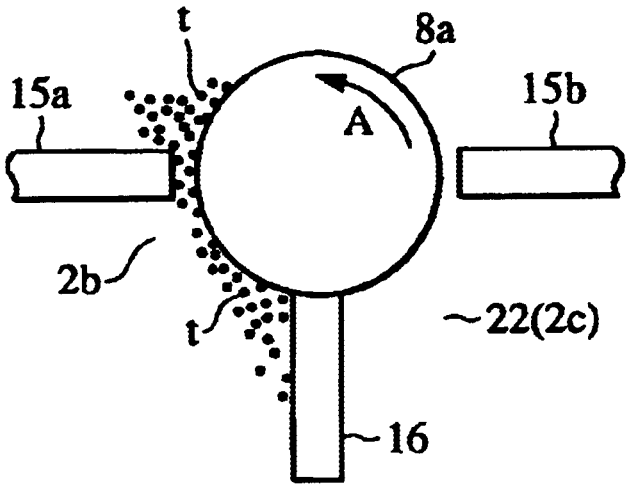
FIGS. 3A and 3B illustrate conveying operations of a toner by a toner conveying member (a magnet roller) of the developing device according to the second embodiment of the present invention.

The structure of the magnet roller serving as a toner conveying member 8*a* will be described in detail. When the toner t in the first toner container 2*a* is to be conveyed to the second toner container 2*b*, as shown in FIG. 3A, the toner t in the toner supplying container 6 is attracted by the magnetic force of the magnet roller (toner conveying member) 8*a* onto the surface of the magnet roller (toner conveying member) 8*a*, and, while rotating the magnet roller (toner conveying member) 8*a* in the direction of the arrow A indicated in the figure (i.e., a counterclockwise direction), the amount of the toner t held on the surface of the magnet roller (toner conveying member) 8*a* is regulated by a toner regulating plate 15*a* having a predetermined gap from the surface of the magnet roller. Then, the toner t is scraped off the surface of the magnet roller (toner conveying member) 8*a* bearing a certain amount of the toner t thereon by a toner scraping plate 16 abutting against the magnet roller (toner conveying member) 8*a* so that the scraped toner t drops into the second toner container 2*b*. With this arrangement, the toner t is conveyed from the toner supplying container 6 to the second toner container 2*b* via the first toner container 2*a*.

Figure 3B:
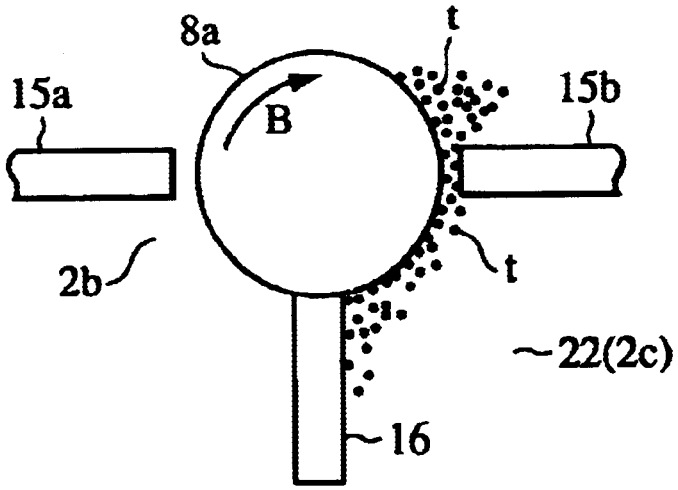
Figure 4:
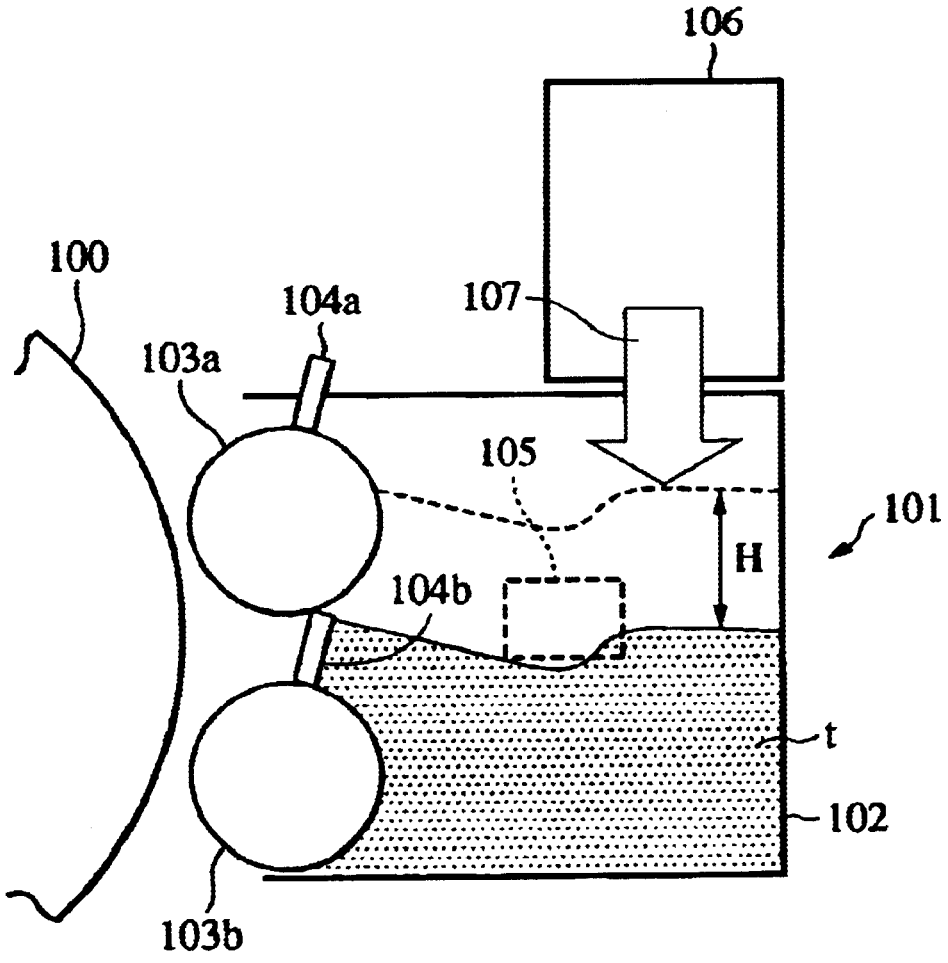
FIG. 4 PRIOR ART
FIG. 4 is a schematic view of an example known developing device.
Figure 5:
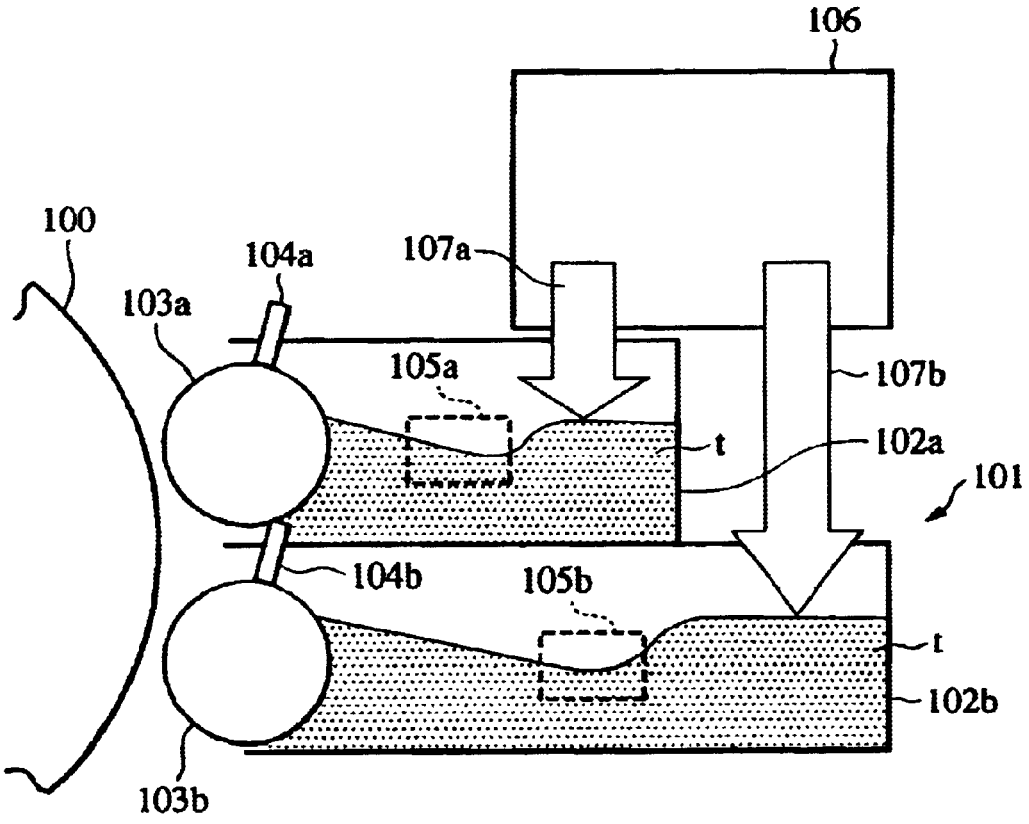
FIG. 5 PRIOR ART
FIG. 5 is a schematic view of another example known developing device.
Figure 6:
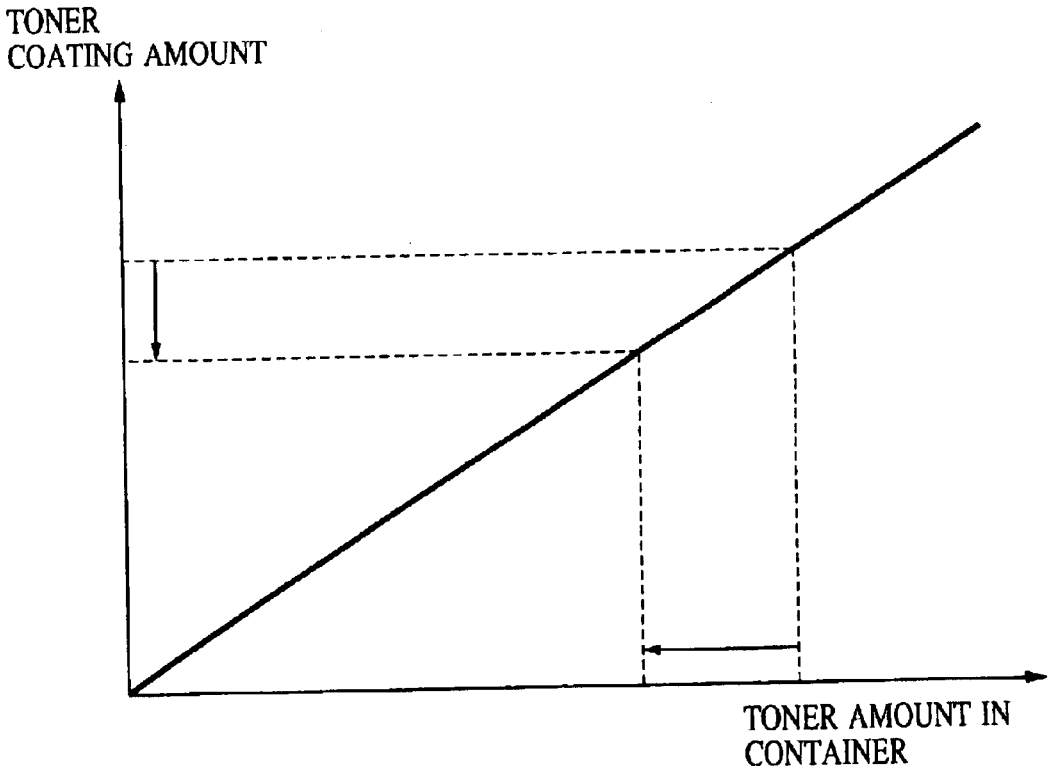
FIG. 6 is a graph illustrating the relationships between a toner amount in a container (a toner container) and a toner coating amount on a developing roller.

When the toner t in the first toner container 2*a* is to be conveyed to the third toner container 2*c*, as shown in FIG. 3B, the toner t in the toner supplying container 6 is attracted by the magnetic force of the magnet roller (toner conveying member) 8*a* onto the surface of the magnet roller (toner conveying member) 8*a*, and, while rotating the magnet roller (toner conveying member) 8*a* in the direction of the arrow B indicated in the figure (i.e., a clockwise direction), the amount of the toner t held on the surface of the magnet roller (toner conveying member) 8*a* is regulated by a toner regulating plate 15*b* having a predetermined gap from the surface of the magnet roller. Then, the toner t is scraped off the surface of the magnet roller (toner conveying member) 8*a* bearing a certain amount of the toner t thereon by the toner scraping plate 16 abutting against the magnet roller (toner conveying member) 8*a* so that the scraped toner t drops into the third toner container 2*c* via the conveying passage 22. With this arrangement, the toner t is conveyed from the toner supplying container 6 to the third toner container 2*c* via the first toner container 2*a*.

Conveyance and supply of the toner t from the toner supplying container 6 to the first toner container 2*a* by the toner supplying device 7 and those from the first toner container 2*a* to the second or third toner container 2*b* or 2*c* by rotation of the toner conveying member (magnet roller) 8*b* are controlled by the controller 23 on the basis of detection data received from the toner-amount detecting sensors 5*a* or 5*c*, respectively.

The conveyances of the toner t to the first to third toner containers 2*a* to 2*c* of the developing device 21 according to the second embodiment will be described below.

When the toner-amount detecting sensor 5*a* detects that the toner t in the uppermost first toner container 2*a* decreases as the developing device 21 operates, the controller 23 causes the toner supplying device 7 to operate on the basis of the received detection data so as to convey the toner t from the toner supplying container 6 to the first toner container 2*a*. The toner t in the first toner container 2*a* is supplied to the developing roller 3*a* by an agitating and conveying member (not shown) and used for developing an electrostatic image formed on the photosensitive drum 9.

Also, when the toner-amount detecting sensor 5*b* detects that the toner t in the second toner container 2*b* lying between the first and third toner containers 2*a* and 2*c* decreases as the developing device 21 operates, the controller 23 causes the toner conveying-member (magnet roller) 8*b* to rotate in the direction of the arrow A indicated in the figure (i.e., a counterclockwise direction) on the basis of the received detection data so as to convey the toner t from the first toner container 2*a* to the second toner container 2*b*. The toner t in the second toner container 2*b* is supplied to the developing roller 3*b* by another agitating and conveying member (not shown) and used for developing an electrostatic image formed on the photosensitive drum 9.

In addition, when the toner-amount detecting sensor 5*c* detects that the toner t in the lowermost third toner container 2*c* decreases as the developing device 21 operates, the controller 23 causes the toner conveying member (magnet roller) 8*b* to rotate in the direction of the arrow B indicated in the figure (i.e., a clockwise direction) on the basis of the received detection data so as to convey the toner t from the first toner container 2*a* to the third toner container 2*c* via the conveying passage 22. The toner t in the third toner container 2*c* is supplied to the developing roller 3*c* by another agitating and conveying member (not shown) and used for developing an electrostatic image formed on the photosensitive drum 9.

In the second embodiment, in the case in which the toner t is supplied from the toner supplying container 6 to the first toner container 2*a* by the toner supplying device 7 and is also conveyed from the first toner container 2*a* to the second or third toner container 2*b* or 2*c* by rotation of the toner conveying member (magnet roller) 8*b*, when a conveyance (supply) amount of the toner t per unit of time from the toner supplying container 6 to the first toner container 2*a* by the toner supplying device 7 is defined as A, the maximum necessary amount of the toner t per unit of time conveyed onto the developing roller 3*a* for developing is defined as B, the maximum necessary amount of the toner t per unit of time conveyed onto the developing roller 3*b* for developing is defined as C, the maximum necessary amount of the toner t per unit of time conveyed onto the developing roller 3*c* for developing is defined as D, and a conveyance (supply) amount of the toner t per unit of time conveyed by rotation of the toner conveying member (magnet roller) 8*b* is defined as E, these amounts are controlled by the controller 23 so as to satisfy the following formulas (2) and (3):

$$A \geqq B+C+D \quad (2), \text{ and}$$

$$E \geqq (C \text{ or } D)\times 2 \quad (3).$$

By controlling these amounts as described above, even when the toner-amount detecting sensors 5*a* to 5*c* detect shortages of the toner t in the corresponding first to third toner containers 2*a* to 2*c* substantially at the same time, the toner t is sufficiently supplied not only to the developing roller 3*a* but also to the developing rollers 3*b* and 3*c* by switching the rotating direction of the toner conveying member (magnet roller) 8*b* as required.

As described above, according to the second embodiment, the toner t is effectively conveyed to the first to third toner containers 2*a* to 2*c* and is thus stably and sufficiently supplied to the developing rollers 3*a* to 3*c*. In addition, the toner conveying member (magnet roller) 8*b* disposed so as to lie in the space formed the upper surface of the second toner container 2*b* and the conveying passage 22 disposed above the third toner container 2*c* conveys the toner t to the second and third toner containers 2*b* and 2*c*, thereby leading to a reduced size of the developing device 21 and also to a stable supply of the toner t to the developing rollers 3*a* to 3*c*.

According to the above-described embodiments, a developing device which has a reduced size and also stably supplies toner to first and second toner containers can be achieved.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A developing device comprising:

a first developer container for containing a developer;

a first developer bearing member for bearing and conveying the developer in said first developer container;

a second developer container for containing a developer;

a second developer bearing member for bearing and conveying the developer in said second developer container, wherein an electrostatic image formed on an image bearing member is developed by supplying the developers from said first and second developer bearing members to the electrostatic image;

developer supplying means for supplying the developer in a developer supplying container to said first developer container; and developer conveying means for conveying the developer in said first developer container to said second developer container in order to supply the developer to said second developer container.

2. The developing device according to claim 1, wherein said developer conveying means is disposed in a communicating portion between said first and second developer containers and comprises a rotating member for conveying the developer from said first developer container to said second developer container.

3. The developing device according to claim 2, wherein the developer is a magnetic developer and is magnetically bored and conveyed by said rotating member.

4. The developing device according to claim 3, wherein said first and second developer containers are integrally disposed with each other and said communicating portion is an opening disposed in a separation portion, which separates said first and second developer containers from each other.

5. The developing device according to any one of claims 1 to 4, further comprising:

detecting means for detecting respective amounts of the developer in said first and second developer containers; and controlling means for controlling operations of said developer supplying means and said developer conveying means on a basis of an output from said detecting means.

6. The developing device according to claim 1, further comprising:

a third developer container for containing a developer; and a third developer bearing member for bearing and conveying the developer in said third developer container, wherein said developer conveying means comprises a single rotating member for selectively conveying the developer in said first developer container to either one of said second and third developer containers.

7. The developing device according to claim 6, wherein the developer is selectively conveyed to either one of said second and third developer containers by switching a rotating direction of said rotating member.

8. The developing device according to claim 7, wherein said second and third developer containers have respective developer-receiving openings therein for receiving the developer from said first developer container and said rotating member is disposed in said developer-receiving openings.

* * * * *

UNITED STATES PATENT AND TRADEMARK OFFICE

CERTIFICATE OF CORRECTION

PATENT NO. : 6,819,883 B2
DATED : November 16, 2004
INVENTOR(S) : Takahiro Nakase et al.

It is certified that error appears in the above-identified patent and that said Letters Patent is hereby corrected as shown below:

Column 1,
Line 27, "bored" should read -- toner --.

Column 2,
Line 65, "relationships" should read -- relationship --.

Column 8,
Line 32, "bored" should read -- borne --.

Signed and Sealed this

Fourteenth Day of June, 2005

JON W. DUDAS
*Director of the United States Patent and Trademark Office*